US005176049A

United States Patent [19]

Neff

[11] Patent Number: 5,176,049

[45] Date of Patent: Jan. 5, 1993

[54] COMPOUND LEVERAGE GRIPPING TOOL WITH CONSTANTLY PARALLEL JAWS

[76] Inventor: Ted Neff, 24701 Raymond, #115, El Toro, Calif. 92630

[21] Appl. No.: 544,758

[22] Filed: Jun. 27, 1990

Related U.S. Application Data

[63] Continuation of Ser. No. 370,919, Jun. 23, 1989, abandoned.

[51] Int. Cl.[5] ..... B25B 7/12

[52] U.S. Cl. ..... 81/360; 81/358

[58] Field of Search ..... 81/360, 359, 358

[56] References Cited

U.S. PATENT DOCUMENTS 1,542,123 6/1925 Eifel ..... 81/360

3,283,624 11/1966 Neff ..... 81/360

*Primary Examiner*—Bruce M. Kisliuk

*Assistant Examiner*—Lawrence Cruz

[57] ABSTRACT

This invention relates to hand tools in general, and more particularly to a gripping plier or wrench having compound leverage gripping power not found in the tools most commonly sold and used today. This tool further has constantly parallel jaws at any adjustment position within its capacity. When constructed as a plier, it grips the workpiece with better than a 10:1 leverage ratio which makes it practically impossible to slip without the operator releasing its grip. When constructed as a wrench for turning nuts, bolts, and fittings, its gripping power holds the workpiece so tightly that there is no possibility of rounding off the corners or otherwise damaging it during the turning operation. Additionally, if a hexagonal object has been previously damaged and has rounded off corners, the wrench version of this tool, in any of its configurations, can effectively grip and turn such an object, a feat that the most commonly used open-end, box-end, or adjustable wrenches cannot perform to any satisfactory degree.

8 Claims, 3 Drawing Sheets

COMPOUND LEVERAGE GRIPPING TOOL WITH CONSTANTLY PARALLEL JAWS

This application is continuation, of application Ser. No. 07/370,919, filed Jun. 23, 1989 now abandoned.

FIELD OF THE INVENTION

This invention relates to hand tools in general, and more particularly to a gripping plier or wrench having compound leverage gripping power not found in the tools most commonly sold and used today.

BACKGROUND OF THE INVENTION

In the prior state of the art, the most commonly used pliers are known as groove-joint pliers and slip-mount pliers that are used for gripping and turning. There are also many other special purpose types of pliers, but few, if any, have the gripping power of the instant invention, with the exception of some types of outting pliers. For example, the well-known and widely used groove-joint plier only has approximately a 4.5:1 leverage ratio, and the slip-joint plier approximately a 3:1 ratio. In addition, the applicant's tool operates with constantly parallel jaws at any adjustment position within its capacity. The most popular and commonly used pliers mentioned above have jaws that must be "scissored" in order to grip the workpiece. This scissoring action is also necessary to cover more sizes within the jaw capacity because of the rather limited number of adjustment positions available. This is particularly true as regards the two-position, slip-joint plier and also applies to the groove-joint plier. Further, the handles of groove-joint pliers to not remain in the same relationship lengthwise. When adjusted from maximum to minimum opening, the pivoting handle containing the lower jaw becomes much shorter than the fixed handle because it must slide upward toward the fixed jaw. These Pliers are also difficult to adjust at times due to the fact that the adjustment grooves are not visible to the user and many times the desired adjustment is not obtained in the first try, whereas the adjustment mechanism of the instant invention is in plain sight and can be easily adjusted to the desired setting.

It is also recognized that there are many types of adjustable wrenches that have constantly parallel jaws, but most are not gripping wrenches that close down on and actually grip the workpiece tightly during a turning operation. They must, instead, maintain sufficient clearance so as to be slipped on and off the workpiece in order to turn it—a slow and tedious procedure at best. In addition, there are many times when the operator leaves too much clearance with an adjustable wrench and this fact, coupled with the well-known tendency for the most common adjustable wrench to spread under heavy torque, has earned this tool the unenviable name of "knuckle-buster".

SUMMARY OF THE INVENTION

It is a primary object of this invention to provide a gripping plier having a gripping leverage ratio of better than 10:1, and gripping jaws that remain in parallel alignment at any adjustment within the capacity of the jaws and without the handles changing their length relationship.

A second object of the invention is to provide such a plier that is quickly and easily adjusted to the correct jaw gap for the job at hand and which has more adjustment positions available than the same size of groove-joint plier or other pliers of similar type.

A third object of the invention is to provide an adjustable wrench for turning different shapes and forms of fasteners, including hexagonal and square, and in alternate preferred embodiments, can also be used on round, oblong, or irregularly-shaped objects in the manner of a plier or pipe wrench.

A fourth object is to provide an adjustable wrench whose jaws can be moved around the workpiece and obtain a new grip without the necessity of removing it from the workpiece, thus permitting the turning operation to be performed in a fast, ratchet-like action.

A fifth object is to provide a pipe wrench version of the tool having gripping power far superior to that of the most commonly used pipe wrench currently available in the state of the art.

A sixth object of my invention is to provide a tool that will accomplish all of the foregoing objects, but which has a minimum of parts and can be manufactured economically.

Other objects and advantages will appear in the combination of the elements, arrangement of the various parts, and particular features of construction which will be pointed out more fully hereinafter and disclosed in the accompanying drawings wherein the preferred forms of the invention are presented.

BRIEF DESCRIPTION OF THE DRAWINGS

Referring now to the drawings, wherein like reference characters designate like parts.

DETAILED DESCRIPTION OF THE PREFERRED EMBODIMENT

Figure 1:
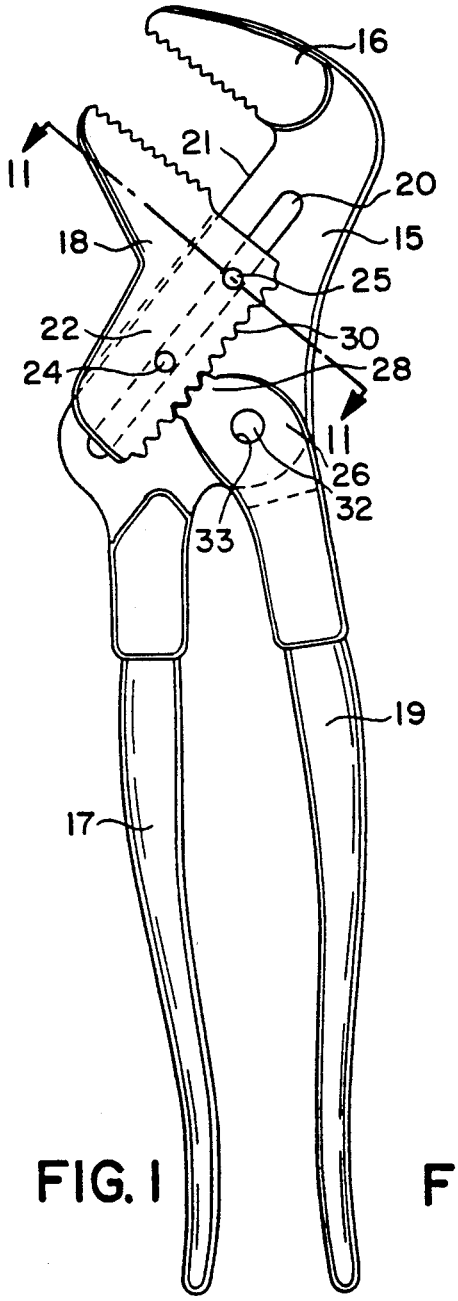
FIG. 1 is a side elevational view of the first preferred embodiment of the invention as a plier, with broken lines showing some of the internal construction.
Figure 2:
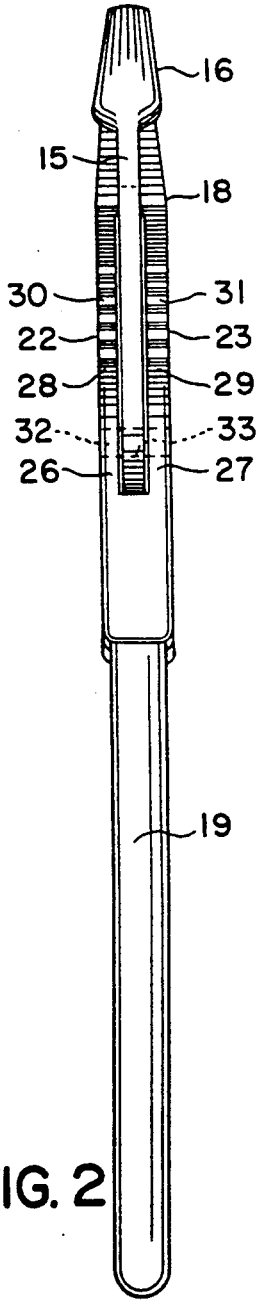
FIG. 2 is an elevational view of the tool shown in FIG. 1, rotated 90 degrees counter-clockwise.
Figure 3:
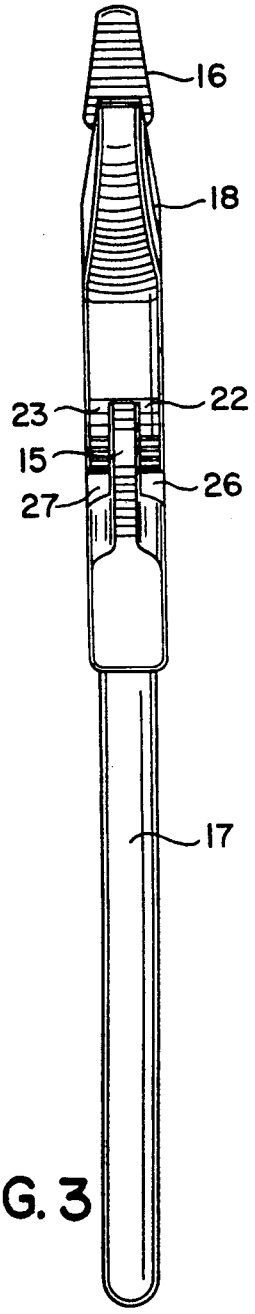
FIG. 3 is an elevational view of the tool shown in FIG. 1, rotated 90 degrees clockwise.

In describing the invention illustrated in the drawings, a body having a flat intermediate section 15 is shown having a fixed serrated jaw 16 on its upper portion, a fixed handle 17 attached to its lower portion, an adjustable jaw 18, and a pivotable handle 19. An elongated slot 20 is disposed in the flat intermediate section 15 substantially perpendicular to the serrated gripping jaws 16 and 18. Serrated jaw 18 is bifurcated on its lower portion forming sidewalls 22 and 23 straddling flat intermediate section 15. Two spaced-apart pins 24 and 25 are affixed to sidewalls 22 and 23 and pass freely through slot 20, permitting jaw 18 to be moved along narrow rail 21 toward or away from jaw 16. Pivotable handle 19 has a bifurcated head portion forming two arms 26 and 27 at its upper end and straddling flat intermediate section 15. On the ends of the two arms 26 and 27 are disposed two gear racks 28 and 29 which engage with the two gear racks 30 and 31 on jaw sidewalls 22 and 23. Pivotable handle 19 is attached to flat intermediate section 15 by a pivot pin 32 in a bore 33 extending through arms 26 and 27 and freely through flat intermediate section 15. Gear racks 28 and 29 are shown as having three gear teeth on each rack but they are not limited to any specific number.

It will be noted that there are more adjustment positions available by using this system of gear racks than are normally available in the use of grooves, as in groove-joint pliers of comparable size and capacity. This increased number of adjustments will cover all sizes of objects within the adjustment range of the jaws, while the jaws remain in perfect parallel alignment, the optimum gripping position. In order to adjust the jaws to a different gap position, pivotable handle 19 is pivoted outward away from handle 17 until the gear racks 30 and 31 on jaw 18 are completely disengaged from gear racks 28 and 29 on pivotable handle 19. Adjustable jaw 18 is then slid either toward or away from fixed jaw 16 on narrow rail 21 and the gear racks are then reengaged at a new position for the work at hand by pivoting handle 19 back toward handle 17. This adjustment is much easier to accomplish than with groove-joint pliers as the gears are in full view and the right jaw setting can easily be chosen.

Figure 4:
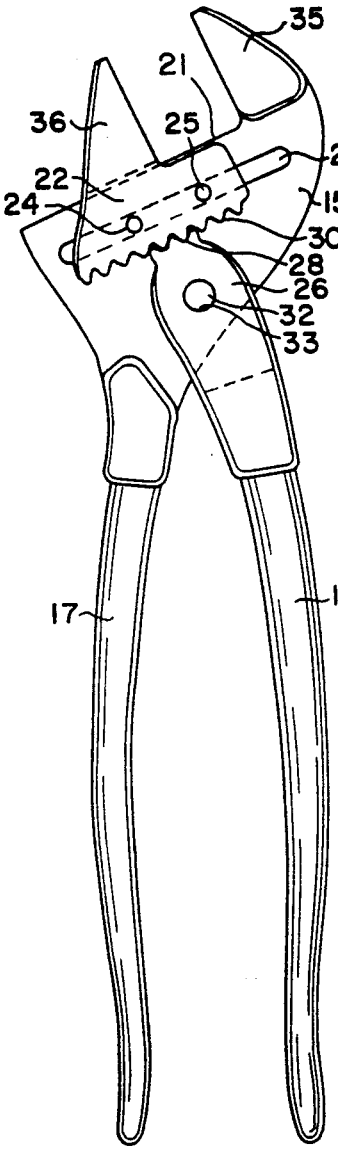
FIG. 4 is a side elevational view of a second preferred embodiment of the invention in the form of a wrench for turning hexagonal and square objects.
Figure 5:
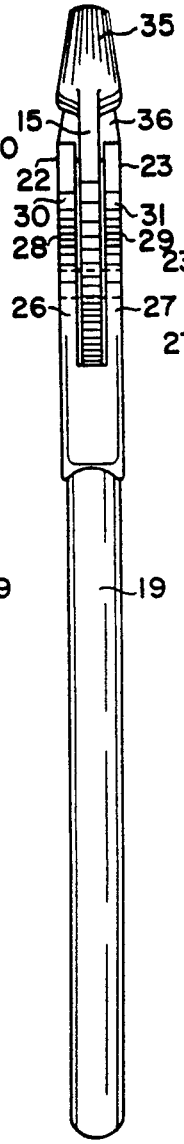
FIG. 5 is an elevational view of the tool shown in FIG. 4 rotated 90 degrees counter-clockwise.
Figure 6:
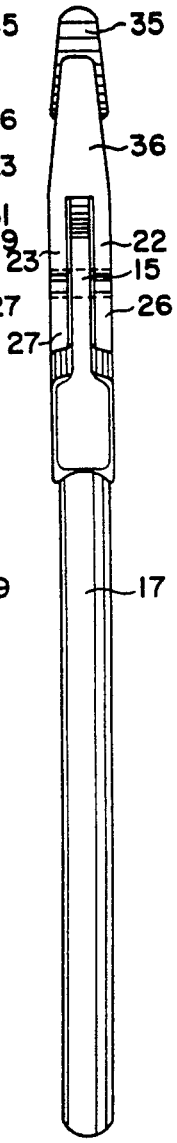
FIG. 6 is an elevational view of the tool shown in FIG. 4 rotated 90 degrees clockwise.

The first preferred embodiment is fully described above. The second preferred embodiment of the invention is illustrated in FIG. 4 in the form of a wrench having straight, smooth gripping surfaces in parallel alignment with each other. In this version of the tool, a hexagonal workpiece can be turned in a fast, ratchet-like manner without removing the tool by just relaxing the grip, opening the jaws, and sliding them around the workpiece and getting a new grip. This action fulfills object number four previously mentioned herein.

Figure 7:
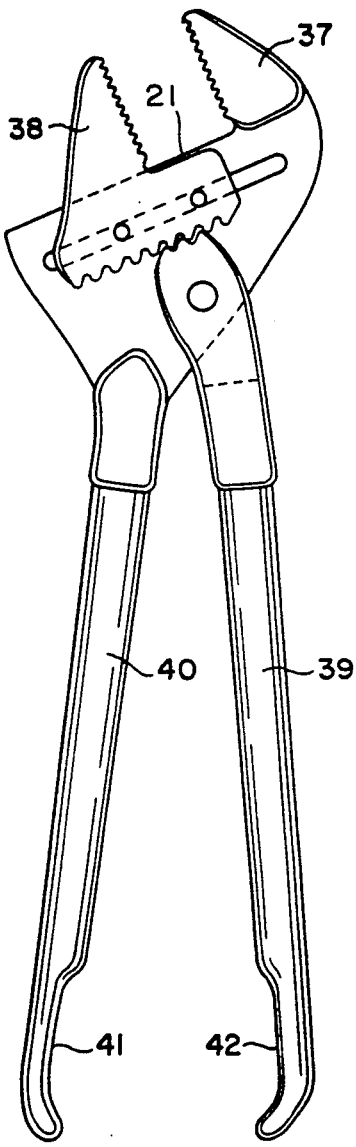
FIG. 7 is a side elevational view of a third preferred embodiment of the instant invention in the form of a wrench having parallel, serrated jaws.

FIG. 7 shows the third preferred embodiment of this invention having straight serrated jaws 37 and 38 which makes this embodiment a multi-purpose plier-wrench capable of gripping and turning hexagonal, square, round, oblong, or irregularly-shaped objects. Also, handles 39 and 40 are different in construction than those in FIGS. 1 and 4, being relatively straight instead of the curved plier-like form and further having recessed areas 41 and 42 at their outer ends. The two recesses 41 and 42 form an opening into which the little finger may be inserted for the purpose of spreading handles 39 and 40 apart and opening the jaws of the tool.

Figure 8:
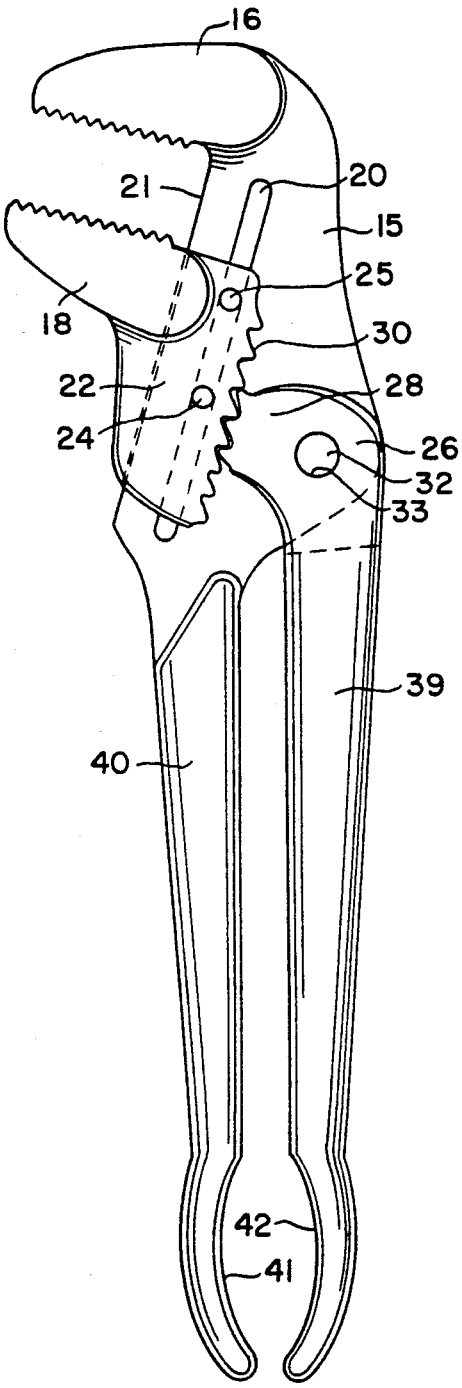
FIG. 8 is an elevational view of a fourth preferred embodiment of the invention in the form of a pipe wrench.

FIG. 8 shows another preferred embodiment of the invention in the form of a pipe wrench. This version is a combination of the jaws 16 and 18 of the plier in FIG. 1 and the handles 39 and 40 of FIG. 7. The only other difference is the angle of the jaws in relation to the body and handles. This gives it the preferred pipe wrench configuration.

Figure 9:
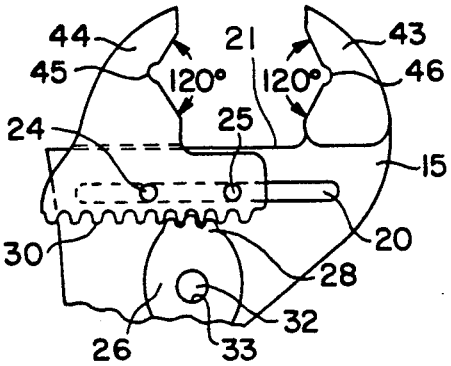
FIG. 9 is an elevational view, partly broken away, of a fifth preferred embodiment of the invention in the form of a wrench having opposing V-shaped jaws with smooth surfaces.

FIG. 9 shows another preferred embodiment of the invention as a wrench having opposed V-shaped jaws with smooth surfaces primarily for use on hexagonal workpieces. In this version of the tool, the V-shaped jaws are formed with angles of substantially 120 degrees. At the inner base of the two V's where the surfaces converge are disposed two small semi-circular recesses 45 and 46. These recesses prevent the jaws 43 and 44 from ever contacting the corners of a hexagonal workpiece, thereby eliminating the possibility of rounding off the corners. This is an important feature, especially if the workpiece is made of relatively soft material, such as aluminum, brass, copper, or plastic. In this configuration, this wrench will be highly advantageous on fuel, oil, hydraulic, air conditioning, and other types of line fittings and connections because of its four-sided jaw grip which prevents distortion or rounding off of the corners. In addition, the wrench can be operated in a fast, ratchet-like action as previously described herein which is not available with ordinary open-end, flare-nut, or other adjustable wrenches, and of course, sockets and a ratchet handle cannot be used in this application.

Figure 10:
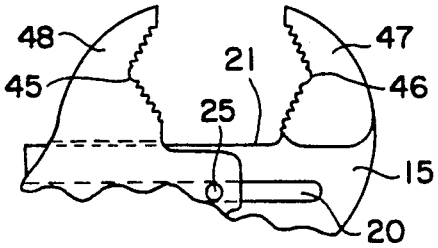
FIG. 10 is an elevational view, partly broken away, of a sixth preferred embodiment of the invention in the form of a plier- wrench combination having V-shaped serrated jaws.
Figure 11:
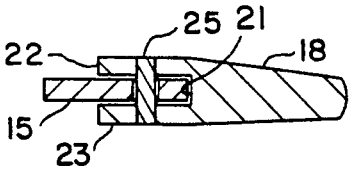
FIG. 11 is a sectional view taken along line 11—11 of FIG. 1.

FIG. 10 shows the same V-jaw configuration as that shown in FIG. 9, except that the four jaw surfaces are serrated. The serrated jaws 47 and 48 permit the tool to be used not only on hexagonal workpieces as does the tool of FIG. 9, but also on round objects, such as pipes, with the added gripping power of four equally opposed serrated jaw surfaces instead of the usual two. This equally opposed four-surface contact reduces the possibility of crushing a thin-walled pipe as is possible with just two parallel jaws.

Figure 12:
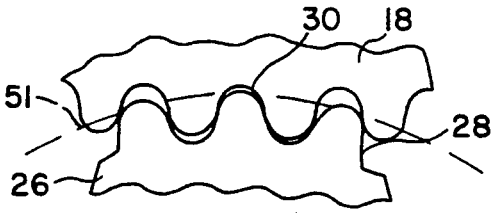
FIG. 12 is an enlarged view of gear racks 28 and 30 in the engaged position with other portions of the tool broken away.
Figure 13:
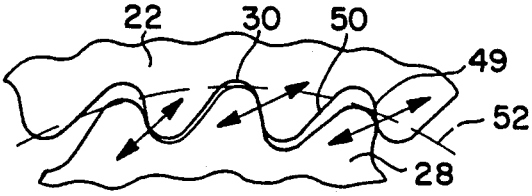
FIG. 13 is an enlarged view, with portions broken away, showing modified teeth configurations on gear racks 28 and 30.

As shown in FIG. 12, gears 28 on handle wall 26 are engaged with gear rack 30 on adjustable jaw 18. The same engagement simultaneously occurs on the reverse side of the tool where gears 29 engage with gear rack 31. The gears shown in FIGS. 1 and 4 are of the standard rack and pinion type as illustrated in FIG. 12. FIG. 13, however, shows a modified gear tooth shape for both the rack and pinion gears. The modification is for the purpose of adding strength to the gear teeth so as to withstand the heavy torque load that is generated by the high compound leverage ratio. In this modified version, the driving surface 49 is of the same configuration as the driving surface on the standard teeth of FIG. 12. However, the back surface, or non-driving surface 50, has been elongated to widen the base of the teeth so that the force being applied in the direction indicated by the arrows will be absorbed almost entirely by the sidewalls 22 and 23 of jaw 18 and the sidewalls 26 and 27 of handle 19, thereby considerably reducing the possibility of shearing off any of the gear teeth. This modified version is used in illustrating the tools of FIGS. 7, 8 and 9. The teeth on pinion gear racks 28 and 29 conform to a relatively small arc, the arc being part of a circle whose center is the axial center of pin 32. This arc is illustrated by the broken lines 51 and 52 in FIGS. 12 and 13.

Although two configurations of gear teeth have been shown herein, it will be understood that they are for illustrative purposes only and the type or configuration of the gear teeth used are not limited to these two types, but may be of any type or configuration that is suitable for the intended purpose.

What is claimed is:

1. An adjustable hand tool comprising a body having a fixed jaw, a gripping surface on said fixed jaw, an adjustable jaw also having a gripping surface, a thin, flat intermediate section, a narrow rail formed on an edge of said thin, flat intermediate section, a fixed handle extending downwardly from the bottom of said thin, flat intermediate section, and a pivotable handle attached to said thin, flat intermediate section;

(a) a bifurcated section on the lower portion of said adjustable jaw straddling said thin, flat intermediate section;

(b) a narrow elongated slot formed in said thin, flat intermediate section, said slot being substantially perpendicular to said fixed jaw and substantially parallel to said narrow rail along which said adjustable jaw may slide, and two spaced apart pins disposed slidably through said narrow elongated slot and affixed to said bifurcated section of said adjustable jaw;

(c) a gear rack formed along the lower edges of said bifurcated section on said adjustable jaw;

(d) a bifurcated head portion formed upon the upper end of said pivotable handle, said bifurcated head portion straddling said thin, flat intermediate section;

(e) a pivot pin inserted through said bifurcated head portion and said thin, flat intermediate section; and (f) pinion gears formed on said bifurcated head portion of said pivotable handle for engaging said gear racks on said adjustable jaw, said handle being pivotable away from said fixed handle a sufficient distance to permit said pinion gears to be disengaged from said gear racks, thereby releasing said adjustable jaw for free movement along said narrow rail to a different jaw gap position where said pinion gears and said gear racks may be re-engaged.

2. In an adjustable hand tool having a body, a fixed jaw, a fixed handle, an adjustable jaw, and a pivotable handle, the improvement comprising:

(a) a gripping surface formed on said fixed and adjustable jaws;

(b) a thin, flat intermediate section formed between said fixed jaw and said fixed handle;

(c) a bifurcated section formed on the lower part of said adjustable jaw, said bifurcated section straddling said flat intermediate section;

(d) a narrow elongated slot formed in said flat intermediate section substantially perpendicular to said fixed jaw;

(e) a narrow rail formed along the top edge of said flat intermediate section along which said adjustable jaw may be moved toward and away from said fixed jaw, said narrow rail being substantially perpendicular to said fixed jaw;

(f) two spaced apart pins passing freely through said narrow elongated slot and affixed to the bifurcated section on the lower portion of said adjustable jaw that is straddling said flat intermediate section.

(g) gear racks formed along the lower edges of said bifurcated section on said adjustable jaw;

(h) said pivotable handle attached to said flat intermediate section, and being bifurcated on its upper head portion which straddles said flat intermediate section and is held thereon by a pivot pin;

(i) pinion gears formed on the bifurcated head portion of said pivotable handle, said pinion gears cooperating with said gear racks on said adjustable jaw for the purpose of moving said adjustable jaw toward and away from said fixed jaw along said narrow rail; and (j) means for disengaging said pivotable handle from said adjustable jaw so that said adjustable jaw may be moved from one engagement position to another, said means comprising a slot forming said bifurcated head portion on said pivotable handle being sufficiently deep so that said pivotable handle may be pivoted far enough to disengage said pinion gears on said pivotable handle from said gear racks on said adjustable jaw, thereby releasing said adjustable jaw for movement along said narrow rail to a new engagement portion whereupon said pinion gears on said pivotable handle are re-engaged with said gear racks on said adjustable jaw.

3. The hand tool of claim 2, wherein said fixed and adjustable jaws have opposing gripping surfaces that are substantially straight, parallel, and smooth.

4. The hand tool of claim 2, wherein said fixed and adjustable jaws have opposing gripping surfaces that are substantially straight, parallel, and serrated.

5. The hand tool of claim 2, wherein said fixed and adjustable jaws have opposing gripping surfaces that are V-shaped and formed at an angle of substantially 120 degrees.

6. The hand tool of claim 5, wherein said fixed and adjustable jaws have opposing gripping surfaces that are smooth.

7. The hand tool of claim 5, wherein said fixed and adjustable jaws have opposing gripping surfaces that are serrated.

8. The hand tool of claim 5, wherein said fixed and adjustable jaws have recesses formed in the corners where said V-shaped gripping surfaces would normally converge and meet.

* * * * *